US009903033B2

(12) United States Patent
Sumant et al.

(10) Patent No.: US 9,903,033 B2
(45) Date of Patent: Feb. 27, 2018

(54) NANOWIRE AND MICROWIRE FABRICATION TECHNIQUE AND PRODUCT

(71) Applicant: UCHICAGO ARGONNE, LLC, Chicago, IL (US)

(72) Inventors: Anirudha V. Sumant, Plainfield, IL (US); Michael Zach, Stevens Point, WI (US); Alan David Marten, Stevens Point, WI (US)

(73) Assignee: UChicago Argonne LLC, Chicago, IL (US)

( * ) Notice: Subject to any disclaimer, the term of this patent is extended or adjusted under 35 U.S.C. 154(b) by 509 days.

(21) Appl. No.: 13/948,652

(22) Filed: Jul. 23, 2013

(65) Prior Publication Data

US 2014/0027294 A1 Jan. 30, 2014

Related U.S. Application Data

(60) Provisional application No. 61/675,227, filed on Jul. 24, 2012.

(51) Int. Cl.
*C25D 1/10* (2006.01)
*C25D 1/04* (2006.01)
*C25D 1/00* (2006.01)

(52) U.S. Cl.
CPC ..... *C25D 1/10* (2013.01); *C25D 1/00* (2013.01); *C25D 1/006* (2013.01); *C25D 1/04* (2013.01)

(58) Field of Classification Search
CPC ..... C25D 1/10; C25D 17/00
USPC ..... 204/212, 216
See application file for complete search history.

(56) References Cited

U.S. PATENT DOCUMENTS 3,123,543 A * 3/1964 Chapman ..... B65G 49/045 204/203
3,434,938 A * 3/1969 Van Sciver ..... B41M 3/00 204/216
4,605,834 A * 8/1986 Inoue ..... B23H 7/105 204/206
6,027,630 A * 2/2000 Cohen ..... B81C 1/00126 205/118
8,236,386 B2 8/2012 Zach
2009/0242016 A1* 10/2009 Zach ..... C25D 1/10 136/252

OTHER PUBLICATIONS

D. Seley, "Electroplate and Life Lithography for Patterned Micro/Nanowires Using Ultrananocrystalline Diamond (UNCD) as Reusable Template", Applied Materials & Interfaces, American Chemical Society, Mar. 15, 2011, vol. 3, pp. 925-930.

* cited by examiner

*Primary Examiner* — Stefanie S Wittenberg
(74) *Attorney, Agent, or Firm* — Foley & Lardner LLP

(57) ABSTRACT

A continuous or semi-continuous process for fabricating nanowires or microwires makes use of the substantially planar template that may be moved through electrochemical solution to grow nanowires or microwires on exposed conductive edges on the surface of that template. The planar template allows fabrication of the template using standard equipment and techniques. Adhesive transfer may be used to remove the wires from the template and in one embodiment to draw a continuous wire from the template to be wound around the drum.

23 Claims, 12 Drawing Sheets

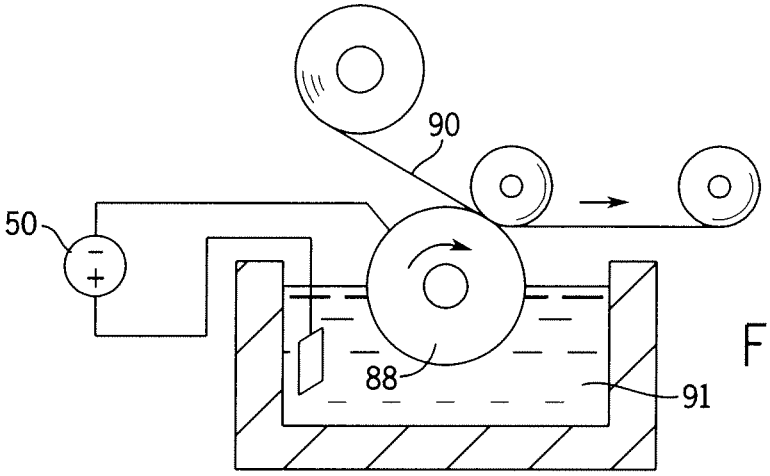
FIG. 10
FIG. 11
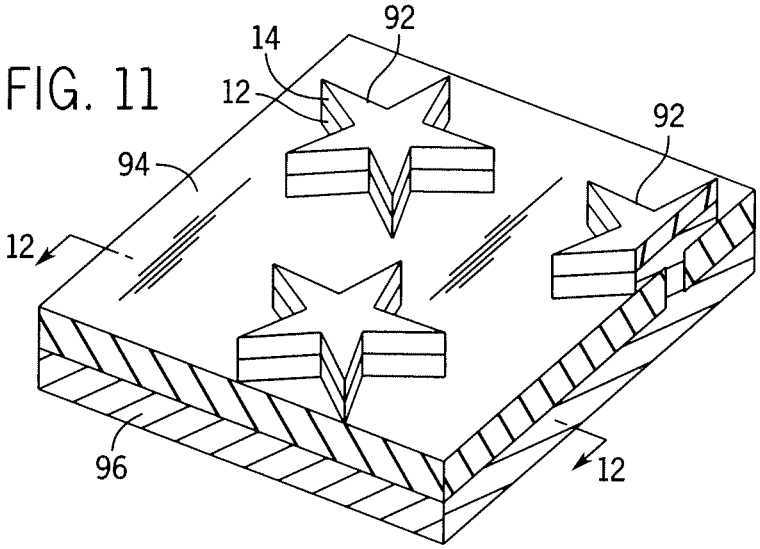
FIG. 12
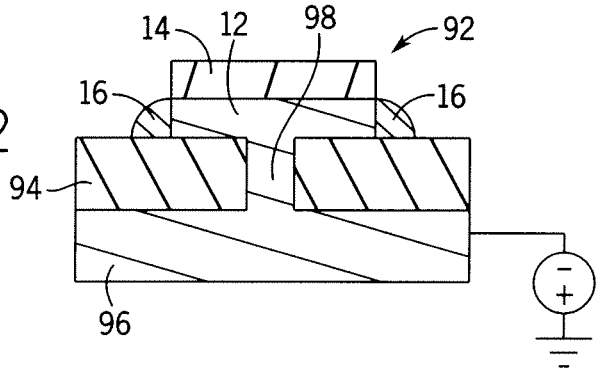

NANOWIRE AND MICROWIRE FABRICATION TECHNIQUE AND PRODUCT

CROSS-REFERENCE TO RELATED APPLICATIONS

This application claims priority from U.S. Provisional Application 61/675,227, filed Jul. 24, 2012, and is incorporated herein by reference in its entirety.

STATEMENT OF GOVERNMENT INTEREST

The United States Government has rights in the invention described herein pursuant to Contract No. DE-AC02-06CH11357 between the United States Department of Energy and UChicago Argonne, LLC, as operator of Argonne National Laboratory. The United States Government may further have rights in the invention described herein pursuant to National Science Foundation grant 0954656.

FIELD OF THE INVENTION

The present invention relates generally to nanotechnology and in particular to a method of creating metallic and semiconducting nanowires, heterogeneous nanowires, and nanowire assemblies using a technique suitable for mass production.

BACKGROUND OF THE INVENTION

Conductive, semi-conductive, and insulating nanowires hold great promise for the creation of new devices including small-scale electrical circuit elements, sensors, and the like. Of particular interest in this regard are metallic nanowires. The creation of relatively long molybdenum nanowires is described in a paper authored by the present inventor and published in Science 2001, 290, (5499), 2120-2123 hereby incorporated by reference. This particular fabrication technique employed highly oriented pyrolytic graphite (HOPG) as a substrate. Nanowires were formed through electrochemical step edged decoration (ESED) techniques in which edges on a terraced surface of the HOPG provided a deposition site for the electrochemically deposited nanowires following those edges.

Fabricating devices from nanoconductors can be difficult. In the above ESED technique, the produced nanowires have irregular orientation resulting from the difficulty of controlling the geometry of the step edges on the HOPG substrate. These variations also affect, to a lesser degree, the diameter of the wires produced. Production of the nanowires is further hampered by the fragile nature and expense of the HOPG. HOPG also contains numerous defects that result in particles forming in between the wires.

Nanowires have been fabricated by using a pocket formed under a layer of photoresist between the photoresist and a substrate as separated by a nanothickness layer of nickel. See "Lithographically Patterned Nanowire Electrodeposition", E. J. Menke et al., Nature Materials 5, 914-919 (2006). This technique makes use of an edge of a larger pattern to define the location of the nanowire eliminating a need for nanoscale line widths in generating the pattern.

U.S. patent application Ser. No. 12/358,801, filed Jan. 23, 2009 and assigned to the same assignee as the present invention, describes a system for making nanowires that employs a robust template of ultrananocrystalline diamond that allows for the electrochemical formation of wires along an edge of conductive diamond and that resists damage over multiple reuses in which the wires pulled from the diamond edge. A continuous or semi continuous process is described in which the template is formed in a drum that may be rotated in through immersion in electrochemical solution.

SUMMARY OF THE INVENTION

The present invention provides an improved method and apparatus for continuous or semi continuous electrochemical wire or wire-shape formation using a flat template. By using a flat template the need for drum, which can be difficult to fabricate, is avoided. In one embodiment, the template is patterned to provide a substantially continuous wire formed over many rotations of the template through electrochemical solution. An adhesive transfer wheel may remove the wire and transfer it to a spooling system.

Specifically then, the present invention provides an apparatus for fabricating wire having a chamber for retaining a volume of electrochemical solution and having a substantially planar template. The template provides a surface having structure presenting an electrically conductive edge formed in a predefined pattern and is mounted for movement with respect to the chamber to partially immerse the template in an electrochemical solution in the chamber and to change a portion of the template so immersed with movement of the template with respect to the chamber. A transfer element provides an adhesive surface and is mounted for movement with respect to the template to pull wires grown by electrochemical action on the structure of the template off of the structure of the template, after contact and separation between the structure and the surface of the transfer element. An electrical power source communicates between and electrode within the chamber connectable to an electrochemical solution in the chamber and a second electrode connecting to the electrically conductive edge of the structure.

It is thus a feature of at least one embodiment of the invention to provide continuous or semi continuous manufacture of nanowires or microwires and wire shapes while avoiding the need for drum-shaped template, thus permitting manufacture of the template using standard integrated surface substrates, for example silicon wafers, and integrated circuit processing techniques, such as optical or electron beam lithography.

The template may be mounted for rotation about a first axis perpendicular to the surface of the template and the transfer element may be a disk rotating about a second axis angled with respect to the first axis, the disk having an edge contacting the surface of the template and following an annular track on the surface of the template concentric about the first axis on the template with mutual rotation of the transfer element and template. In one implementation, multiple annular tracks are utilized and a stranded nanowire is formed.

It is thus a feature of at least one embodiment of the invention to provide a simple of removing nanowires and microwires from the template on a continuous basis and in a manner compatible with cyclic immersions of the template in an electrochemical solution.

The edge of the disk of the transfer element may be beveled to have a non-perpendicular angle with respect to the second axis.

It is thus a feature of at least one embodiment of the invention to reduce the sheer and/or strain on the nanowirenanowires and microwires during removal by tipping the transfer wheel axis toward the axis of the template.

The apparatus may include a drum rotating about a third axis and providing an adhesive surface and mounted for movement with respect to transfer element to pull wires off of the transfer element with rotating contact between the drum and transfer element.

It is thus a feature of at least one embodiment of the invention to permit the transfer of arbitrarily long continuous wires from a finite sized template.

The drum may translate along the third axis with respect to the transfer element and spool a wire received from the transfer element in a helical coil along a surface of the drum.

It is thus a feature of at least one embodiment of the invention to provide an orderly winding of extremely long micro-wire or nanowire and to reduce damage thereto.

The predefined pattern of the electrically conductive edge may define at least one substantially continuous circle on the planar template centered about the axis.

It is thus a feature of at least one embodiment of the invention to permit a single wire to be formed by multiple rotations of the template through an electrochemical bath. By forming the wire along a continuous radius it may be removed tangentially with minimal bending.

The apparatus may include second chamber for holding a releasing liquid and positioned to admit a portion of the transfer element to move through the releasing liquid with rotation of the transfer element about the second axis. In one implementation, the liquid aids in removal of the wire by replacing the wire polymer cohesive force with a liquid-polymer interaction that is stronger.

It is thus a feature of at least one embodiment of the invention to provide a mechanism for releasing nanowires and microwires from an adhesive transfer element to allow the adhesive transfer element to be reused on a continuous or semi continuous basis.

The second chamber may include an agitation element for agitating the releasing liquid.

It is thus a feature of at least one embodiment of the invention to provide for the release of microwires or nanowires with reduced distortion and mechanical damage.

The template may be mounted for rotation about a first axis perpendicular to the surface of the template.

It is thus a feature of at least one embodiment of the invention to provide a simple method of cyclically immersing the template in an electrochemical solution as is required for continuous or semi continuous processing.

The chamber may open upward to admit a portion of the template during rotation of the template with the surface of the template extending vertically.

It is thus a feature of at least one embodiment of the invention to provide a simple method of providing different zones on the surface of the template allowing for both exposure of the template to electrochemical solution and a drying of the template in a cyclic fashion.

The predefined pattern of the electrically conductive edge may alternately define multiple discontinuous elements positioned over the surface of the template.

It is thus a feature of at least one embodiment of the invention to provide a similar mechanism for producing small wire shapes.

In one embodiment the transfer element may be a flexible tape having an adhesive surface and pressed against a surface of the template by a guide to follow an annular track on the surface of the template concentric about the first axis on the template with rotation of the template.

It is thus a feature of at least one embodiment of the invention to provide a transfer of small wire shapes to a carrier for later use or placement.

The apparatus may include an electronic computer executing a stored program controlling operation of the apparatus selected from the group consisting of: (a) a rate of rotation of the substrate through the electrochemical solution; (b) an applied voltage across the electrodes; and (c) the composition of the electrochemical solution.

It is thus a feature of at least one embodiment of the invention to provide a mechanism that may precisely controlled processing conditions, for example, through feedback or preprogram schedules for improved manufacturing efficiency or research.

The electrically conductive edge on the planar template may be at an obtuse angle with respect to the substrate.

It is thus a feature of at least one embodiment of the invention to provide for improved removal of electrochemically formed wires on the edge by tipping the edge in the direction of removal.

These particular features and advantages may apply to only some embodiments falling within the claims and thus do not define the scope of the invention.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The foregoing and other objects, aspects, features, and advantages of the disclosure will become more apparent and better understood by referring to the following description taken in conjunction with the accompanying drawings, in which:

FIG. 10 is a simplified depiction of a continuous manufacturing process using the technique of the present invention to create nanostructures on a rotating drum and extract them using a tape reel;

FIG. 11 is a perspective fragmentary view of the surface of the rotating cylinder of FIG. 10 having a pattern to form nanostructure loops of non-convex polygons;

FIG. 12 is a cross-section along line 12-12 of FIG. 11 showing a conductive via system electrically joining the patterns of FIG. 11;

DETAILED DESCRIPTION OF THE PREFERRED EMBODIMENTS

Figure 1A:
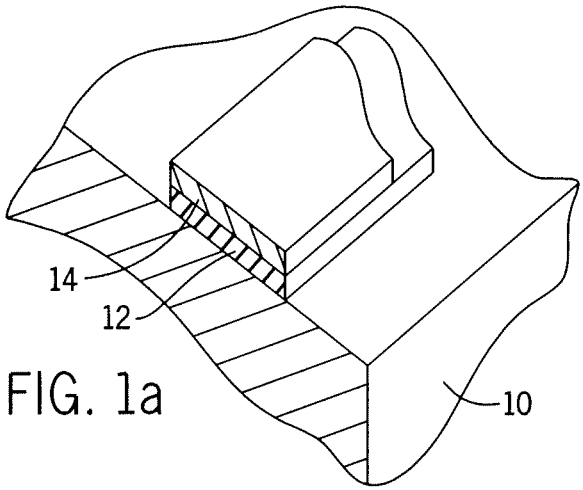
FIGS. 1*a* and 1*b* are a fragmentary, perspective, cross-sectional views of an ultranano crystalline diamond (UNCD) template used to grow to small-scale wires by electrodeposition per the present invention before and after the electrode deposition.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Construction of Small Scale Wires

Referring now to FIG. 1*a*, the present invention may employ a generally planar substrate 10, for example, a silicon wafer having an upper insulating surface of silicon dioxide, or sapphire, or quartz wafer. A conductive layer 12 of ultranano crystalline diamond (UNCD) may be formed on the substrate 10 using an intervening layer of tungsten or molybdenum (not shown) plated or sputtered on the surface of the substrate 10. This conductive layer 12 of ultranano crystalline diamond may be a few nanometers thick measured in a direction perpendicular to the plane of the substrate 10.

The conductive layer 12 may be patterned using conventional lithography techniques following predefined mask artwork. For example, the generation of the patterned conductive layer 12 may, employ photoresist techniques to apply copper (not shown) to the substrate 10 as a negative image of the patterned conductive layer 12. A layer of UNCD may then be applied over the exposed areas of the substrate 10. UNCD growth on copper is poor the UNCD forming on the copper layer may be removed by dissolving the copper in between the patterned conductive layer 12 removed by chemical etching to leave the patterned UNCD of the conductive layer 12. Alternatively, the patterned conductive layer 12 may be patterned by using reactive ion etching or other similar technique.

Preferably before the removal of the copper, an insulating layer 14, for example, nonconducting UNCD, may be placed over the patterned conductive layer 12 covering its surface and optionally one edge. The insulating layer 14 may be insulating by virtue of the lack of doping of the diamond of the layer 14, in contrast, the conductive layer 12 may be conductive (or semi-conductive) through the introduction of a doping material for example boron (forming a p-type semiconductor) or nitrogen (forming an n-type semiconductor) or by surface treatment such as ion implantation with other doping agents. The insulating layer 14 generally covers the patterned conductive layer 12 except at the edges of the patterned conductive layer 12 and without overhang of the patterned conductive layer 12 along a direction normal to a surface of the substrate 10 so as to permit later removal of wires without destruction or removal of the insulating layer 14.

Alternatively, complete layers of doped diamond (forming conductive layer 12) and undoped diamond (forming insulating layer 14) may be grown on a substrate 10 which can be coated with a patterned layer of nickel, SiO2, or other material which resists reactive ion etching. Thus where no layer of nickel or other material exists, both layers of diamond are removed creating an exposed edge of the conductive layer 12 which may be used as an electrode.

Figure 1B:
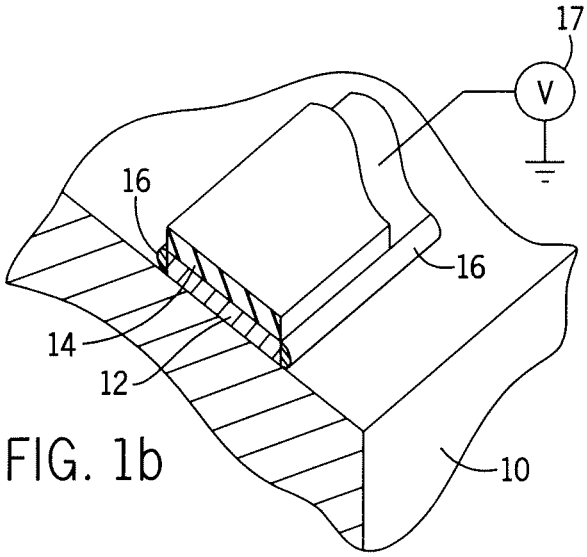

Referring now to FIG. 1*b*, a voltage source 17 may be connected to the conductive layer 12 to grow, by electrodeposition, a wire 16 at the exposed step edge of the patterned conductive layer 12. In one embodiment, the wire 16 may be tungsten which is catalytic to diamond but other materials may also be used. The size of the wire 16 is determined by the thickness of the patterned conductive layer 12 and the duration of the growing process and thus may be easily controlled to nanoscale dimensions.

An optional super filling plating bath per T. Moffat, et al. Electrochem. and Solid-State Lett., 5, 110 (2002) may be used to give even more growth to the wires. Further, after fabrication on the substrate 10 as described above, the wires 16 may be extended or joined by chemical vapor deposition processes to make insulators, semiconductors, metals, and alloys.

The size of the wire 16 may be much smaller than the dimensions of the patterned conductive layer 12 allowing the latter to be produced by conventional lithography techniques that could not be used to directly produce the wire 16. In this way, for example, micron scale photolithography can be used to control nanoscale wires per Penner described above. However, the present technique permits reuse of the pattern both by eliminating the overhanging resist layer and through the use of a resilient (non-sacrificial) pattern material.

The ultrananocrystalline diamond has a number of desirable features for this application as a pattern material. It has sufficient conductivity for acting as an electrode when doped and sufficient resistance when undoped to provide an insulator. It provides continuous high nucleation density, is robust against hydrogen and high temperatures, and has a large electrochemical window. Its strength and adhesion properties allow it to be used repeatedly with the removal of the wires 16.

Example 1

It is believed that template of the substrate 10 conductive layer 12 and insulating layer 14, produced as described, can be placed in a bath of 5 millimolar sodium tungstate solution with the conductive layer 12 biased at −1.11 volts with respect to the surrounding solution using an electrode in contact with the solution. The voltage may be applied in short pulses according to constant voltage "stop run chronoamperometry" techniques. The wires can then be reduced in a reduction atmosphere of hydrogen heated to 500 degrees Celsius to produce a pure metal.

Wires having a thickness of substantially 10 nm and thousands of nanometers in length have been produced in this fashion using highly oriented pyrolytic graphite instead of UNCD. To date this technique has been used to successfully produce wires from cobalt (using an ionic liquid), copper, tellurium, lead, and gold, zinc, platinum, palladium, cadmium, cadmium telluride, cadmium sulfide and zinc sulfide. It is anticipated that this technique may be used for depositing nanowires of any material that is capable of being electrodeposited. With the proven ability to utilize ionic liquids, refractory metals such as Ti, Nb, Zr, Ta and reactive metals such as Li, Na, K, Rb, Mg, Ca, and Al and intrinsic semiconductors such as Si Ge are expected to be possible. In addition most any binary, ternary or more complex materials such as III-V and II-VI semiconductors and superconductors should be capable of being electrodeposited.

Transfer of Wires

Figure 2A:
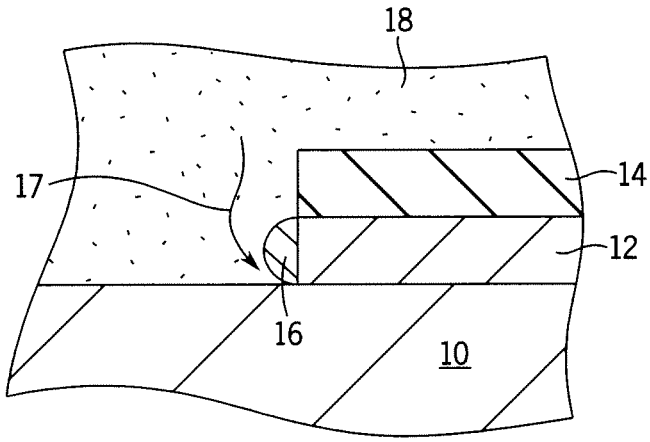
FIGS. 2*a*-2*e* are elevational views of a cross-section of FIG. 2 at multiple stages of a transfer process moving the fabricated wires to a second substrate to be combined with other fabricated wires in a complex pattern.

Referring now to FIG. 2*a*, after production of the wires 16, a transfer material 18 may be applied to the substrate 10 (to cover the insulating layer 14, the patterned conductive layer 12 and the wires 16). This transfer material 18 may, for example, be a highly flowable polymer material such as PDMS, cyanoacrylate, polystyrene, epoxies, glue, tape or other material that may be used to adhere to the wire 16, including for example, formed-in-place ice. The transfer material 18 may flow under the wire 16 as indicated by arrow 19 to better remove the wire 16 as will be described. This underflow can be increased by placing the patterned layer on a pedestal (not shown) for example of insulator such as UNCD.

Figure 2B:
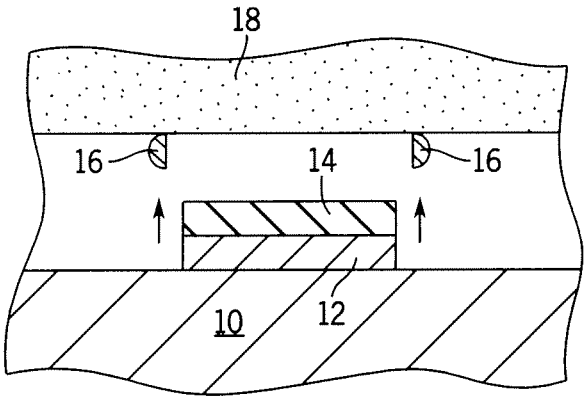
Figure 15:
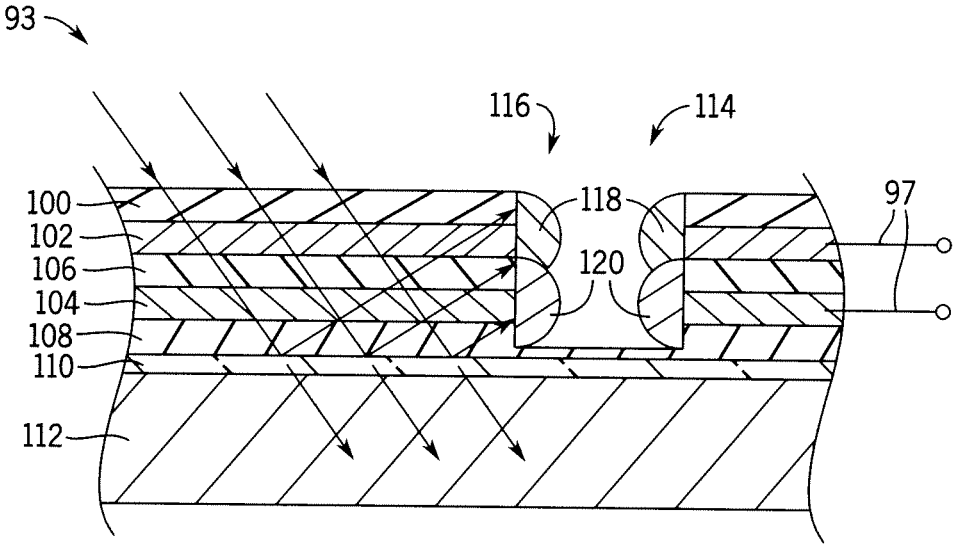
FIG. 15 is a cross-sectional view along line 15-15 of FIG. 14.
Figure 16:
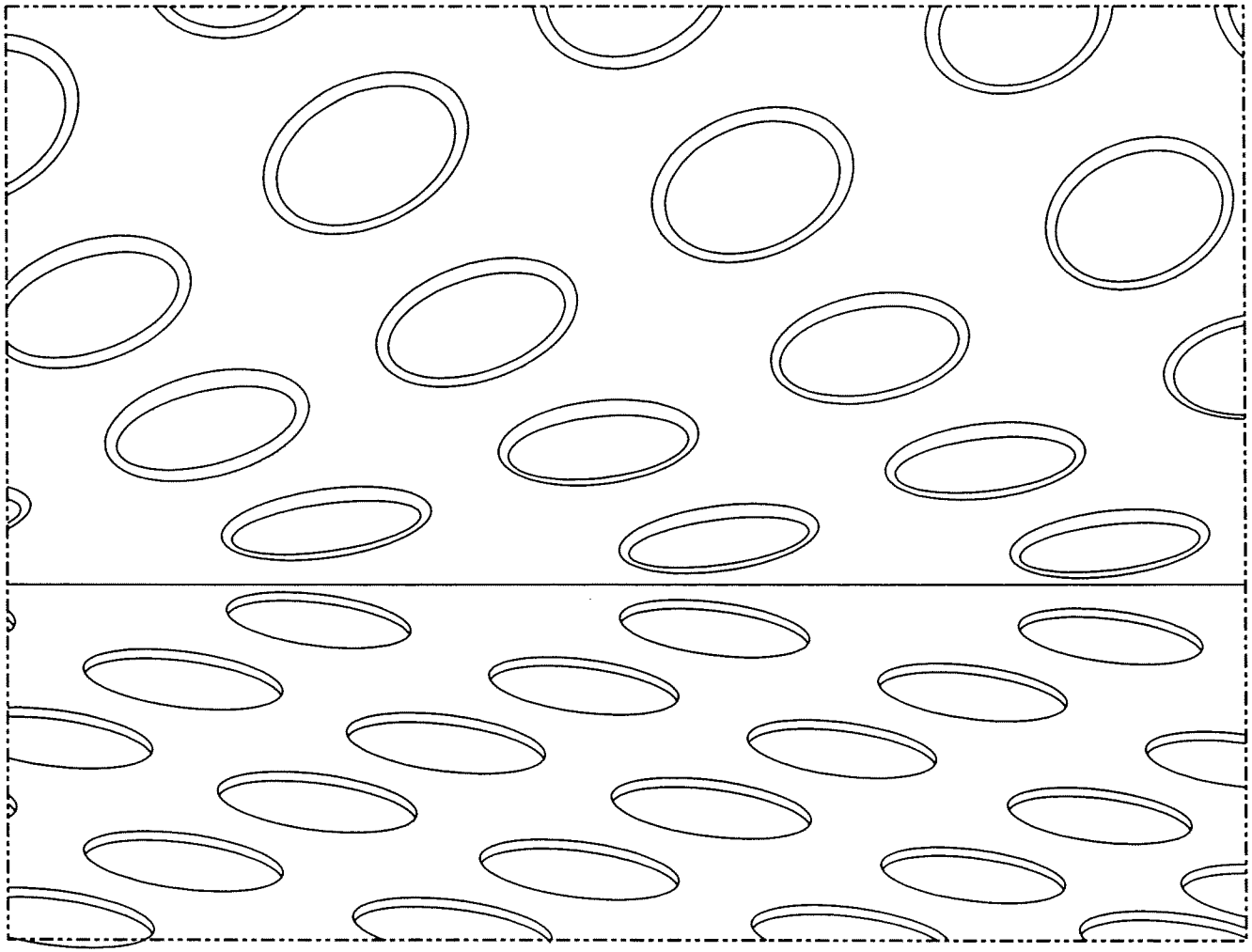
FIG. 16 is a depiction of microwires in the outline of loops produced by the present invention in the process of being stripped off of the pattern.
Figure 17:
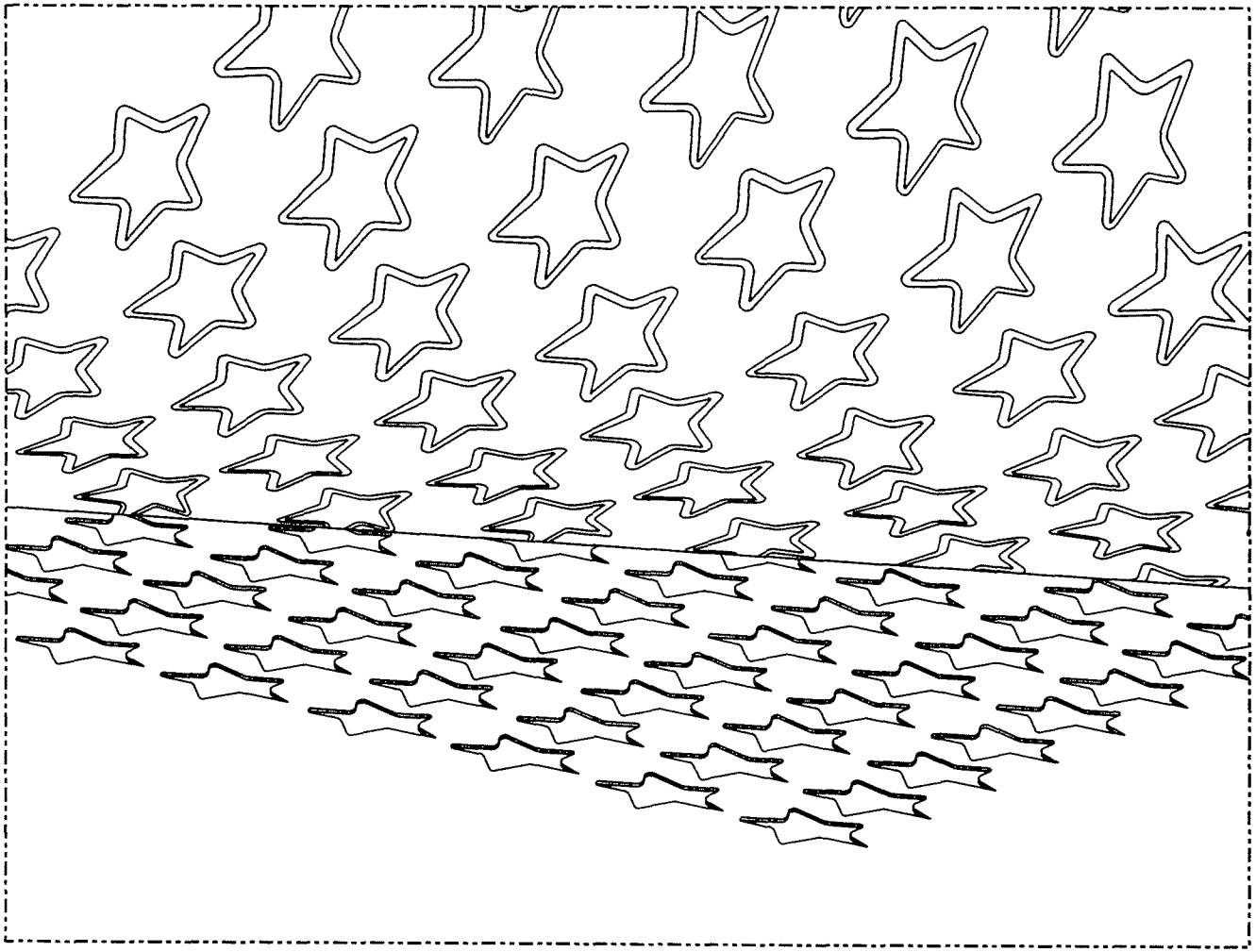
FIG. 17 is a depiction similar to that of FIG. 16 showing microwires in the outline of stars.

The transfer material 18 may then be pulled away from the substrate 10 as shown in FIG. 2*b* pulling the wire 16 away from the patterned conductive layer 12 by means of a relatively greater cohesive force between the transfer material 18 and the wires 16 than between the wires 16 and the patterned conductive layer 12. FIGS. 15 and 16 show wires 16 being removed from a substrate 12 using First Contact™ polymer commercially available from Photonic Cleaning Technologies of Platteville, Wis. USA.

Figure 2C:
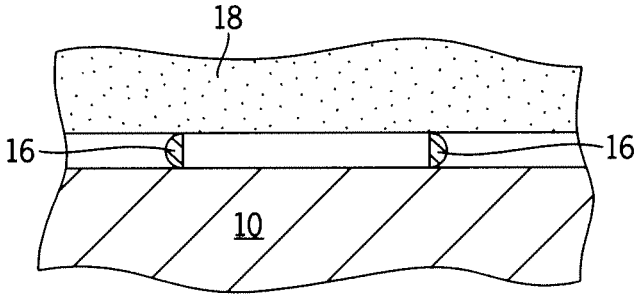

At this point, the transfer process may be complete and the transfer material 18 may serve as the substrate on which the wires 16 will be used. Alternatively however, as shown in FIG. 2*c*, the wires 16, as held by the transfer material 18, may then be placed against a second substrate 22 and retained on that second substrate 22 as the transfer material 18 is removed. This can be done in many ways, for example, by ensuring a greater cohesive force between the wires 16 and the second substrate 22 than between the wires 16 and the transfer material 18. This condition may be promoted by pretreating the second substrate 22 with an adhesive material or adhering the wires 16 to the second substrate 22 through pressure or heating or the like. Or the adhesive quality of the transfer material 18 may be decreased, for example, by flexure shear or melting. Alternatively, the transfer material 18 may be dissolved or eroded after the wires 16 are in place.

Figure 2D:
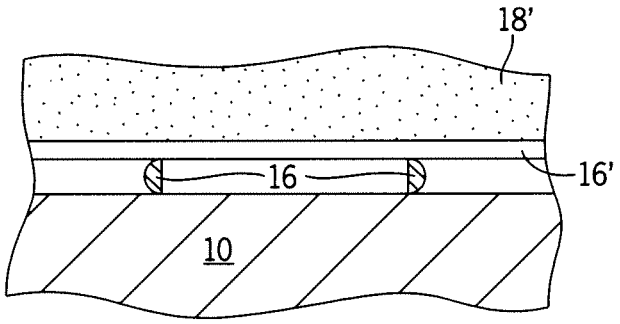
Figure 2E:
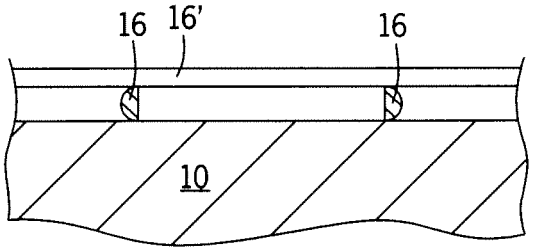

Subsequently as shown in FIG. 2*d*, an optional second set of wires 16' may be placed in a different orientation on top of the wires 16, for example, to provide electrical interconnections between wires 16, 16'. As will be described further below, through the use of the second UNCD electrode positions near the conductive layer 12 but isolated electrically therefrom, portions of the wires 16 and wire 16' may be coated with second and third materials that when connected together provide a heterojunction or the like, or the wires 16 and wire 16' may be grown from different materials or differently treated to provide electrically active junctions.

Figure 3:
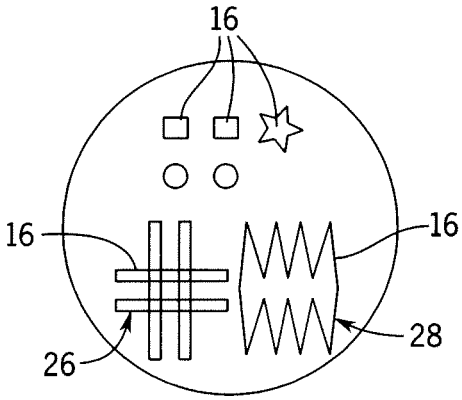
FIG. 3 is a top plan view of possible complex patterns that may be created by the process of FIG. 2.

Referring now to FIG. 3, this transfer process allows ESED techniques to produce complex arrays of wires 16, such as by combining a wire bridging element 24 extending between two parallel wires 16 or a grid 26 of crossing wires 16 or convoluted wire 28 such as might be used to create electrode sensors or electrical devices. The loop ends of the grid 26 of the convoluted wire 28 may be cut or etched away if separate conductors are desired.

Electrical Devices

Figure 4:
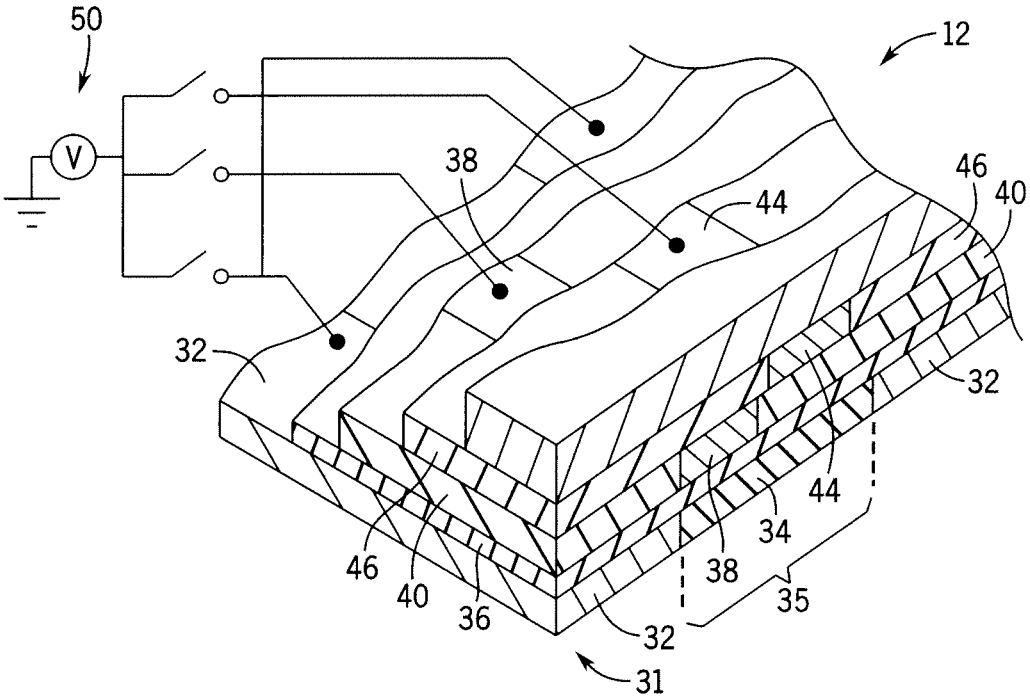
FIG. 4 is a FIG. similar to that of FIG. 2 showing a multilayer UNCD pattern having electrically independent conductors for electrodeposition.

Referring now to FIG. 4, the patterned conductive layer 12 for creating the wires 16 may be quite complicated including, for example, a layer 32 of conductive UNCD presenting an edge 31 for growing a wire where the conductive layer 32 is broken by an insulating portion 34 defining a gap 35.

This layer 32 may coated with an insulating layer 36 also filling the gap 35. The insulating layer 36 may be in turn capped with a second conductive layer 38 positioned over a first portion of the gap 35 and flanked by insulating portions 40 so that the end of the conductive layer 38 is exposed over part of the gap 35 in the edge 31.

A third conductive layer 44 may be positioned above the second conductive layer 38 so that conductive layer 44 is exposed over a different portion of gap 35 than conductive layer 38. Conductive layer 44 is flanked by insulation 46.

Each of the conductive layers 32, 38, and 44 may be electrically isolated from each other but, along the dimension of the edge, may form a nearly continuous conductive path. Each of these conductive layers 32, 38, and 44 may be separately connected to an electrical power source 50 to allow for separate electrochemical deposition at the particular conductive layers 32, 38, and 44.

Figure 5:
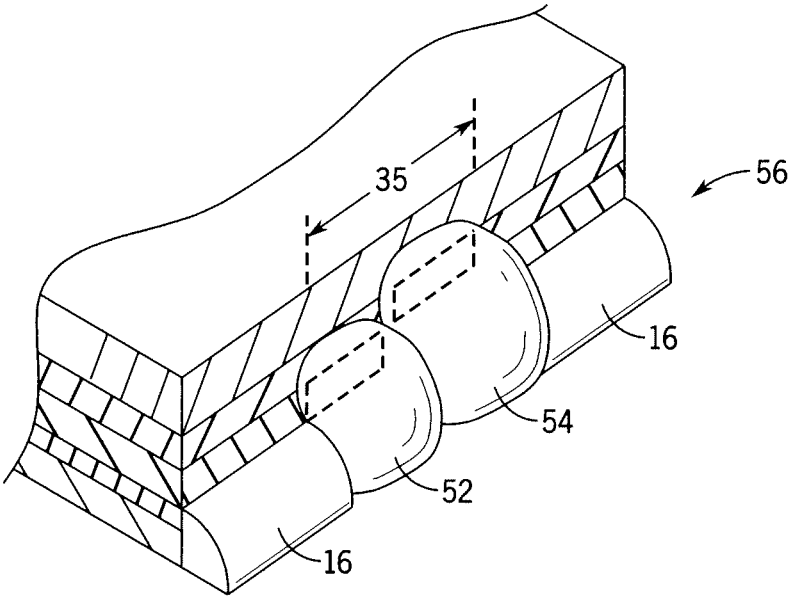
FIG. 5 is a FIG. similar to that of FIG. 3 showing a face of the multilayer UNCD pattern used to grow a heterogeneous wire, for example for an electrical device.

Referring now to FIG. 5, this process of selective activation of each of the conductive layers 32, 38, and 44 may be used to first grow a wire 16 (for example tungsten) at the edge of conductive layer 32 on either side of the gap 35. Next, a first junction element 52 of a different material (for example tungsten doped with a different material or a doped semiconductor or the like) may be grown on the exposed edge of layer 38 at one end of the gap 35 connected to one wire 16, and a second junction element 54 (also of a different material) may be grown at the exposed edge of layer 44 joined with junction element 52 and a second portion of the wire 16. Possible materials for first junction element 52 and the second junction element 54 include CdS, CdSe, CdTe, Al, CuO, ZnS, ZnSe, as well as others. The second junction element 54 may be grown until it touches the first junction element 52 as detected by a change in the observed voltage at electrode at conductive layer 38.

The two different junction elements 52 and 54 may also be dissimilar metals providing a thermocouple junction providing low mass, high response rate thermocouples. Alternatively, the junction elements 52 and 54 may be the same material applied at different times and subject to different doping conditions or maybe implemented by different materials of the wires 16 themselves. The heterojunction formed can be a photocell, a PN junction, a thermocouple, or other heterojunction of types known in the art.

In this way, a heterogeneous wire 56 may be formed so that electricity may flow through a first portion of the wire 16 to junction element 52 and then to a second junction element 54 and then to a second portion of the wire.

Wires as Substrates for Diamond

Figure 6:
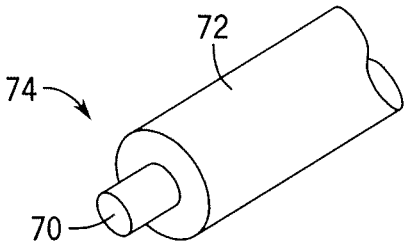
FIG. 6 is a perspective view of a tungsten wire produced per the present invention and subsequently treated to be coated with diamond.

Referring now to FIG. 6, more generally, the present invention may be used to create a wires 70 that may be used alone or (in the case of molybdenum or tungsten for example) as a substrate to grow a surrounding super hard material such as crystalline diamond layer 72 by supersaturation of carbon into the tungsten or molybdenum wire that is exuded as a crystalline diamond to create a clad wire 74. The tungsten wire 70 may then be removed by chemical processes to create crystalline diamond wires or left in place to provide a better interface for metallurgical bonding. Typically the diamond will not completely surround the wire as shown but will coat only one side when the process is conducted with the wire supported on its side. The clad wire 74 may be used, for example, as an electrical conductor with an insulator along its length, for example, to provide for an insulated microelectrode usable in medicine or the like.

Nanostructure Composites

Figure 7:
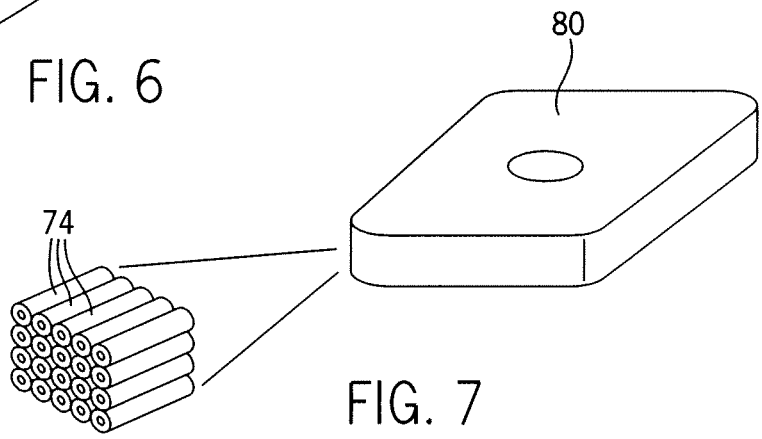
FIG. 7 is a perspective view of a cutting tool assembled of bundled wires of the type shown in FIG. 5.

Referring to FIG. 7, a set of these wires 74 may be sintered with metal particles into a cutting tool 80 optionally with an alignment to impart a directional hardness. The diamond coating is shown surrounding a wire core, but more typically only an upper surface of the wire will have a diamond coating when the wires are treated on one surface. The diamond outer claddings can be joined with Co, V, Fe, Ti, Nb or other transition metals, the latter which provide a binding matrix portion offering a ductility similar to a polymer with fiberglass. More generally, wires 74 may be combined with metal particles in metal injection molding techniques (MIM) in which particles coated with polymer are injection molded into complex shapes, the binding polymer removed and the metal particles sintered around the nanostructures. The injection molding techniques, in one embodiment, aid in aligning the elongated forms. In these cases, both the metal particles and wires may be coated with a binder and only the metal particles may be coated with a binder. In another embodiment, magnetized wires may be encapsulated into hollow polymer spheres similar to those aiding in drug delivery. The spheres along with metal particles may be packed into molds. Subjected to a strong magnetic field the wires which are loose within the sphere would align prior to removal of polymer spheres through the sintering process.

Figure 8:
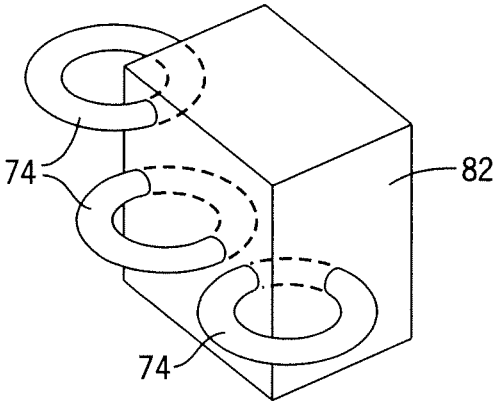
FIG. 8 is a fragmentary perspective view of a cutting tool showing nanostructures embedded in a cutting tool matrix.
Figure 9:
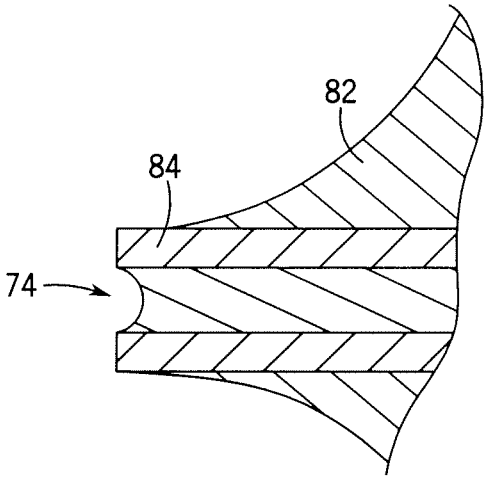
FIG. 9 is a fragmentary cross-section of the matrix material of a cutting tool abraded from around a wire showing the self-sharpening features anticipated in the inventive composite materials.

Referring also to FIG. 8, for the purpose of producing cutting tools but also for other composite materials, the wires 74 may be in the form of loops which better anchor the wires within the matrix material 82 particularly when they are partially exposed during abrasion of the tool. A similar effect may be obtained by patterning kinks in the wires 74. Referring to FIG. 9, the extremely hard outer diamond layer 84 of the wires 74 may provide a natural "cat's claw" self-sharpening effect in which the matrix material 82 providing supporting resilience erodes preferentially around the diamond layer 84 to produce a nanoscale sharpened edge. The high thermal conductivity of diamond may also provide for assistance in preserving the cutting tool edge, beyond the effect of the hardness of the diamond or other superhard material. In one embodiment, $ReB_2$ is utilized as an overcoating over the wires or diamond coated wires.

The use of the diamond wires 74 need not be limited to this cutting tool but these wires may be used as a component for other types of powdered metallurgy or may be used to create composites in the manner analogous to fiberglass/polymer composites with the diamond wires distributed within a matrix of sintered materials or polymers or other matrices.

Diamond wires are heat resistant and have high thermal conductivity (four times that of copper) and so may be used in material applications requiring high temperature resistance or conductivity. High thermal transfer may help produce fire resistant materials. Diamond wires may also be useful for materials that must be scratch resistant. Diamond wires may be useful to alter the electrical characteristics of materials or to create sensors.

Mass Production of Nanostructures

Referring now to FIG. 10, mass production of the nanostructures for the above purposes, for example, may be done using a rotating cylinder 88 providing a template as described above exposed on the outer circumference of the cylinder. Referring to FIG. 11, the outer surface of the cylinder, for example, may have multiple isolated islands 92, exposing edge layers 12 following an outline of non-convex polygons. Roughly, $10^{10}$ identical 500 nm rings or ovals or other shapes can be manufactured on a 4-inch area. And because the pattern is not consumed in this process mass production of nanostructures is rendered practical.

The edge layers 12 may be covered with non-overhanging insulating layers 14 of common dimension and placed on a second insulating layer 94 (for example non-doped UNCD) providing a planar substrate over top of a conductive layer 96. As shown in FIG. 12, a conductive via 98 may pass upward from the conductive layer 96 through the insulating layer 94 to conductive layer 12 of each of the islands 92 to provide common electrical connection permitting the growth of loops around the islands 92.

The conductive layer 96 may be connected to a biasing electrical power source 50 by means of a slip ring or other similar system. The cylinder 88 may be rotated by a motor (not shown) through a bath 91 of electrochemical solution providing material of the nanostructures so that they form on its outer surface as the cylinder 88 during the time a portion of the cylinder 88 is immersed.

An adhesive material such as adhesive tape 90 may be applied to the exposed portion of the cylinder 88 after the nanostructures are grown to remove the nanostructures. The nanostructures may be removed from the tape by a variety of means including a solvent bath acting on the adhesive, mechanical scraping, or burning of the tape.

Improved Solar Cell

Figure 13:
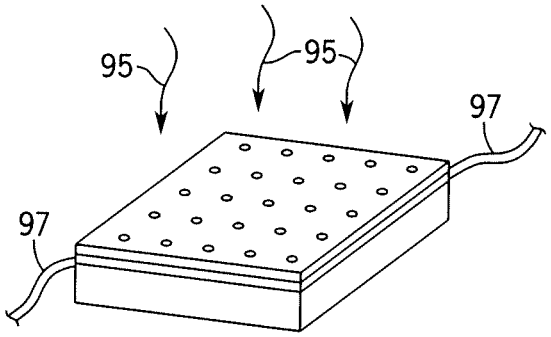
FIG. 13 is a perspective view of a solar cell constructed using principles of the present invention using UNCD.
Figure 14:
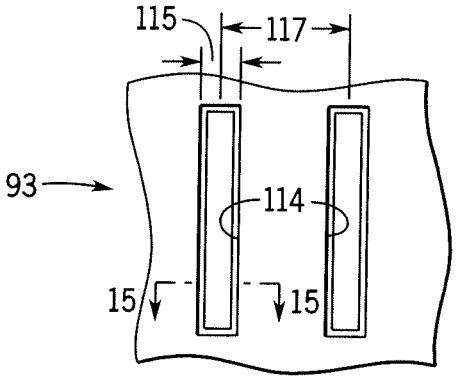
FIG. 14 of the top plan detailed view of the solar cell of FIG. 13 showing a spacing of holes having deposited photoelectrically active materials.

Referring now to FIG. 13, the techniques of the present invention may be used to produce an improved solar cell 93 receiving light 95 at an upper planar surface and providing electrical voltage at electrodes 97. With prior methods the nanowires could be difficult to manipulate and utilize, for example by e-beam lithography or other patterning processes. Certain embodiments of the described invention provide a integral isolated electrical contact, which aids in utilize the structure. Referring also to FIGS. 14 and 15, the planar upper surface may include a first outer layer of insulating UNCD 100 over top of a conductive layer 102 of UNCD which in turn is separated from a second conductive layer 104 of UNCD by an insulating layer 106 of UNCD. The second conductive layer 104 may rest on a final non-conductive layer 108 of UNCD, in turn, resting on a tungsten film 110 placed on top of a substrate 112, for example, a silicon wafer. The effect is to provide for two electrically isolated conductive layers 102 and 104 which may connect to the electrodes 97 respectively to conduct electricity from the solar cell 93.

Referring specifically to FIG. 14, the surface of the solar cell 93 may be punctured by a set of spaced holes 114 through the transparent layers 100-110 and separated by unpunctured areas of the transparent layers 100-110. The size 115 of the holes 114 and their spacing 117 may be adjusted to optimize the light collection area versus the electrical generation area of the solar cell as will now be described. In one embodiment, the holes may be slots extending across the direction of light conduction to better capture the light, or the holes may be shaped to promote focusing of light reflected off of the edges of the holes onto previous or adjacent holes.

As shown in FIG. 15, each of the holes 114 presents inner edges having areas substantially perpendicular to the face of the substrate 112 upon which may be grown photoelectrically active heterojunction materials 116. For example, one material 118 may be cadmium telluride formed in a toroid within hole 114 grown around the exposed conductive layer 102 as described above and the other material 120 cadmium sulfide formed in an adjacent abutting toroid and grown about layer 104. Light 95 entering transparent layers 100-110 is trapped by internal reflection and conducted to the various holes 114 where electrical power is generated at the heterojunctions and extracted through electrodes 97 (which are, in one embodiment, electrically isolated from one another). It should be appreciated that present photovoltaics and solar thermal structures fail to utilize the full spectrum of light. The most common photovoltaics typically utilize only the light higher in energy than green. Solar thermal typically is inefficient at using the higher wavelengths such as green, blue, violet, and UV. As described herein, certain embodiments allow for the passage of the less-useful lower energy wavelength light through the photovoltaic to be harnessed by a solar thermal collector.

The hole may be formed using reactive ion etching that cuts only about halfway through layer 104. This allows the layers 100-104 to be detached from the substrate 112 by a KOH etching of the silicon of the substrate 112, for example. The layer 108 may then be removed and replaced with an antireflection layer (not shown) and layers 100-104 placed over a thermal solar panel. Long wavelength light may pass through layer 104 or the anti reflective coating currently not shown providing for heating, for example, for a solar thermal (hot water) collector.

Because the collection area of the heterojunctions between materials 118 and 120 is vertically disposed, the blockage of sunlight is correspondingly reduced. This design may be augmented with grown in place wires to provide lower electrical resistivity for the collection of the electrical power. This design does not have any metallic conductors that also shade the solar cell. This has zero metal contacts that shade the active areas.

The thin film of diamond provided by layers 100-110 may provide useful spectral separation allowing different heterojunctions to be tuned to different frequency bands. Significantly, the diamond also provides a robust outer surface that will not degrade and is resistant to environmental contamination. Diamond may provide advantageous thermal conductivity properties with respect to transmitting heat to the substrate 112.

Improved Manufacturing Apparatus with Planar Templates

Figure 18:
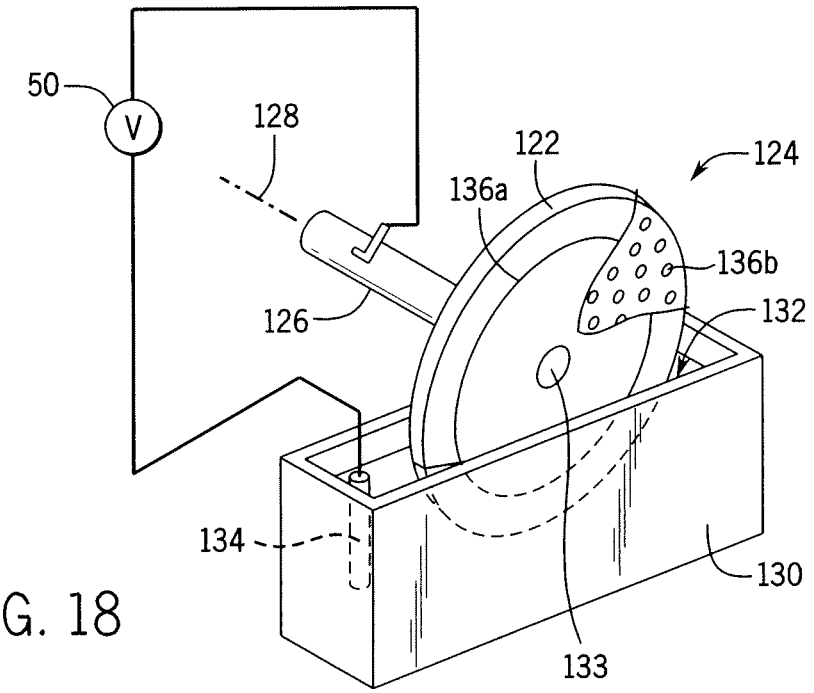
FIG. 18 is a perspective view of a planar template for making micro or nanowires showing parts of a mechanism employing that template.

Referring now to FIG. 18, the mass production of nanostructures may be facilitated through the use of a generally planar template 122, for example, providing a flat disc having surface structure 124 providing the insulation-capped conductive edges described above with respect to any of FIGS. 1-5 and 11-17. Use of a planar template 122 facilitates generation of the necessary surface structure 124 using standard fabrication techniques adapted to planar structures both in the formation of a substrate wafer and in the processing of that wafer using integrated circuit type techniques including optical or electron beam lithography and the like.

The planar template 122 may be mounted, for example, on a shaft 126 to rotate about a horizontal axis 128 so that a face of the planar template 122 having the surface structure 124 is substantially vertical to be partially received in an upwardly open chamber 130.

The chamber 130 may be filled with electrochemical bath 132 for the growing of nanowires and other similar structure on the surface structure 124. In this way, with rotation of the planar template 122 about the axis 128, the surface structure 124 is repeatedly raised from and lowered into the electrochemical bath 132.

An electrical connection 133 may be made between the shaft 126 and a conductive layer of the surface structure 124 forming the edges described above, so that a electrical power source 50 may be connected between the conductive layer of the surface structure 124 (through shaft 126) and an electrode 134 in contact with electrochemical bath 132. Current from the electrical power source 50 may thereby drive the electro-deposition of material onto the edges of the surface structure 124.

The surface structure 124 may provide for one or more concentric circular edges 136*a* for the formation of a continuous wire (as will be described below). Alternatively the surface structure 124 may provide a set of discrete discontinuous edges 136*b* for the generation of shapes, for example, as described with respect to FIGS. 3, 6-9, 11-12, and 16-17 by electrochemical action driven by the voltage provided by the electrical power source 50. Generally the wire structures or other structures will be formed on that portion of the planar template 122 immersed in the electrochemical bath 132 and after such formation the structures will rise out of the solution 132 with rotation of the template 122 for access as will be described.

Figure 19:
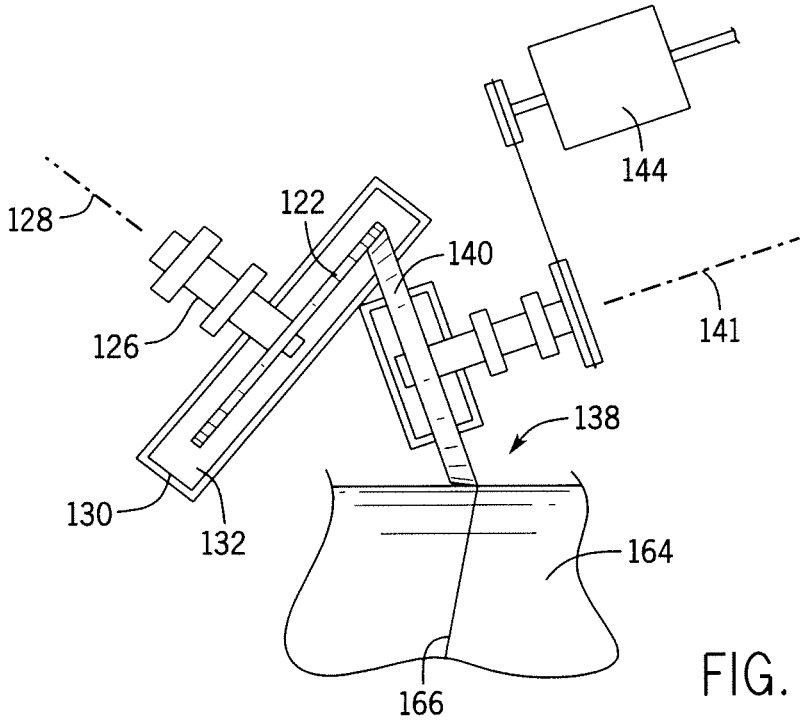
FIG. 19 is a top plan view of the template of FIG. 18 together with a transfer element removing wire forms from the template for transfer to an adjacent drum.

Referring now to FIG. 19 planar template 122 may contact, at its front surface, the edge of a transfer element 138 which in one embodiment may be a disk 140 having a chamfered edge defining a relatively flat section of a cone. The disk 140 of the transfer element 138 may be rotatable about an axis 141 centered on the disk 140 and aligned with an axis of the cone defining its edge. The axis 141 is angled with respect to axis 128 to align the chamfered edge with the front face of the planar template 122 at a point of contact between the template 122 and the transfer element 138 above the level of the electrochemical bath 132 so that the structure 124 may be substantially dried as will be described below.

Figure 21:
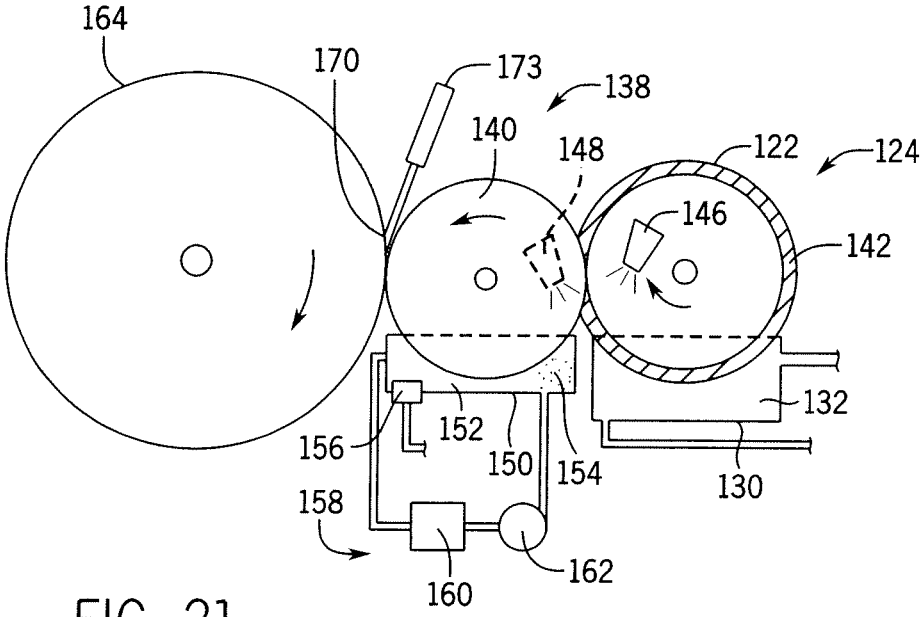
FIG. 21 is a simplified diagrammatic representation of the interaction between the planar template, the transfer element, and the drum in the processing and removal of elements formed of nanowires or microwires.

Referring also to FIG. 21, a chamfered edge of the disk 140 may thus provide a rolling engagement with a peripheral annulus 142 on the surface of the planar template 122 as the two rotate together, the disk 140 driven by a motor 144 and the planar template 122 driven by the disk 140 in contact therewith. It will be appreciated that the radial width of the peripheral annulus 142 may be arbitrarily adjusted by increasing or decreasing the thickness of the chamfered edge of the transfer element 138.

The chamfered edge of the transfer disk 140 may be coated with an adhesive material to pull wires formed on the surface structure 124 of the planar template 122 from the planar template 122 in the manner described above with respect to FIG. 10. Preferably the adhesive material will be reusable. For example such adhesive materials may be cross-linked polymers in a gel form, for example, as commercially available from Gel-Pak of Hayward, Calif. The adhesive material may be selected according to the particular fabrication process at hand in order to provide sufficient attachment forced to separate electrochemically grown wires from the conductive edges of ultrananocrystalline diamond.

Referring still to FIGS. 19 and 21, at the area of contact between the planar template 122 and the transfer element 138, fabricated nanostructures on the edges of the surface structure 124 will be removed from the planar template 122 as attached to the surface of the beveled edge of transfer element 138. To facilitate this process, the surface of the template 122 before its contact with the transfer element 138 may be drained by natural drainage and dried by an air knife 146 directed against the rotation of the template 122 to dry and help loosen nanostructures on the structure 124. In one embodiment, a "solvent knife" may be used, i.e. keeping the nanowires wet and utilizing a solvent that aids in removal of the salts.

Referring also to FIG. 18, discrete nanostructures formed by elements 136*b* may then be carried by rotation of the transfer element 138 into a second chamber 150 containing a loosening solvent 152 which may release the nanostructures 154 from the surface of the transfer element 138 by solvent action together with mechanical agitation provided, for example, by ultrasonic transducer 156. An air knife 148 may be directed against the direction of rotation of the beveled edge of the transfer element 138 to further help remove the nanostructures 154 and to prevent the solvent 152 from being transferred to the template 122.

A circulation system 158 may be provided whereby solvent 152 is recycled through the chamber 150 through a separator element 160, for example, a filter or centrifuge and then returned by pump 162 back to the chamber 150 to provide for essentially continuous extraction of the nanostructures 154.

Figure 20:
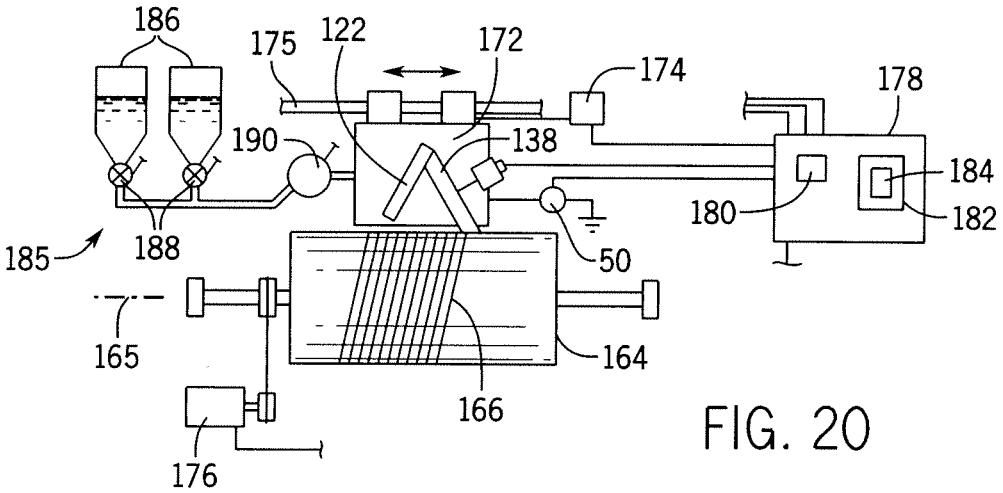
FIG. 20 is a simplified block diagram of the template, transfer element, and drum as integrated into a manufacturing system including computer control of the planar template, the transfer, the drum and showing electrical and fluid control systems.

Referring now to FIGS. 19,20, and 21, alternatively, a continuous wire nano structure formed by edges 136*a* may be carried by the transfer element 138 over into contact with a drum 164. In this case the second chamber 150 may be empty or removed entirely.

The drum 164 provides a cylindrical outer surface a generally parallel to the beveled edge of the disk 140 at its point of abutment with the beveled edge of disk 140 removed from its contact with the planar template 122. The drum 164 may rotate about a third axis 165 generally different in angle from axes 141 and 128, necessary to produce this abutment. By the intra-engagement of the planar template 122, the transfer element 138, and the drum 164, a wire 166 formed by edge 136*a* may be transferred continuously with little distortion, stretching, strain or tension to the outer cylindrical surface of the drum 164. It is necessary only that the outer surface of the drum provides an adhesive material whose tack is relatively stronger in retaining the wire 166 then the adhesive on the surface of the beveled edge of the transfer element 138. In one embodiment, the drum 164 may be coated with a wax or thermoplastic adhesive material that is softened at a point 170 immediately before contact with the transfer element 138, for example, by a laser 173, to increase the stickiness of the wax so as to effect the transfer of the wire 166 from the transfer element 138 to the drum 164.

Referring now to FIG. 20, the planar template 122 and transfer element 138 may be mounted on a movable carriage 172, for example, sliding along a way 175 under the control of a motor drive 174. The sliding of the carriage 172 may be synchronized with rotation of the drum 164 about axis 165 so as to spool the continuous wire 166 in the helical path around the outer surface of the drum 164. The pitch of that helical path is greatly exaggerated in FIG. 20 and will generally be quite fine so as to allow a considerable length of wire 166 to be collected on the drum 164, for example, a kilometer or more. A motor 176 rotating the drum 164 may be under the control of a computer 178 which also communicates with the drive 174 to provide the desired winding pitch.

The computer generally will include a processor 180 communicating with a memory 182 holding a stored program 184 to provide the control described herein. The computer 178 may also control the electrical power source 50, for example, with respect to duty cycle, on and off time, current flow, and voltage and may further control a fluid handling system 185 comprised of one or more reservoirs 186 of different electrochemical solutions and solvents that may be metered through metering valves 188 and pump 190 into chamber 130. Each of the valves 188 and pump 190 as controlled by the computer 178 may provide for predetermined schedules of applied voltage, rotational speed of the template 122, and electrochemical composition of the bath 132 during this process.

Figure 24:
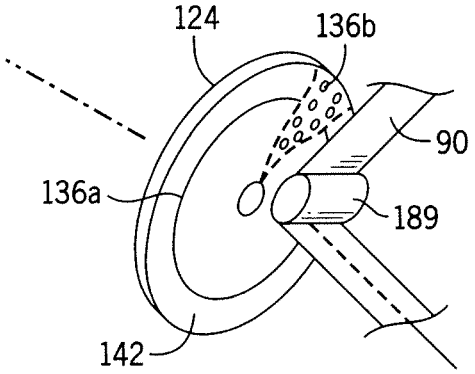
FIG. 24 is a fragmentary view of an apparatus similar to that of FIG. 18 showing the use of an adhesive tape rather than an adhesive transfer wheel to remove microwires or nanowires from the planar substrate.

Referring momentarily to FIG. 24, it will be appreciated that the features described above with respect to FIG. 10 may be combined with the planar template 122 to provide, for example, an adhesive tape 90, for example, having adhesive on the flexible backer material such as paper or plastic that may pass over a roller 189 positioned to press an adhesive surface of the tape 90 into a rolling contact with the front surface of the planar template 122 to sweep out an annular area 142 over which either a wire formed on edge 136*a* or discrete components faulted on surfaces are edges 136*b* (shown in FIG. 1) will be removed. In this way the benefits of the planar template 122 may be combined with those of the tape 90.

Template with Angled Face

Figure 22A:
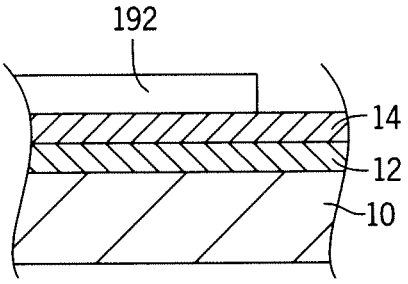
FIG. 22*a* is a figure similar to FIG. 2*a* showing the application of a soft photoresist to an insulating and conductive layer formed on the template of the present invention prior to etching to produce a conductive edge.
Figure 22B:
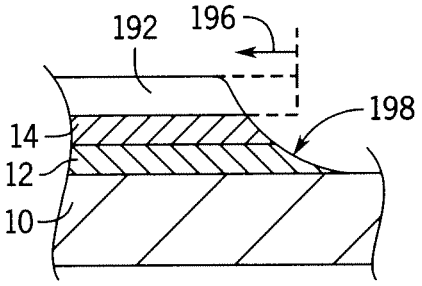
FIG. 22*b* is a figure similar to FIG. 22*a* showing a sloped edge of the insulating and conductive layers caused by the erosion of the photoresist during the etching process.
Figure 23:
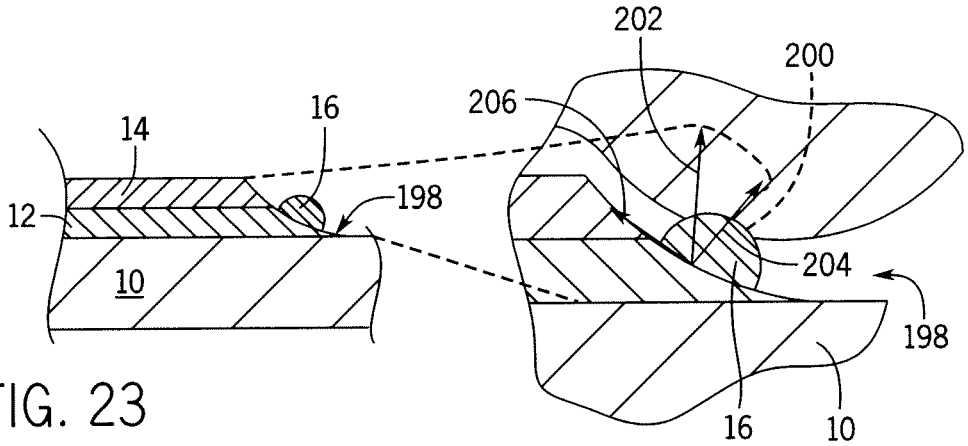
FIG. 23 is a figure similar to FIG. 22 showing the orientation of a micro-wire or nanowire grown on an exposed edge of the conductor and removal forces when removed using an adhesive.

Referring now to FIG. 22*a* in the fabrication of any of the insulation-capped conductive edges described above with respect to any of FIGS. 1-5 and 11-17, the conductive layer 12 and insulating layer 14 maybe capped with a "soft" resist layer 192 in contrast, for example, to a metal layer. The soft resist layer 192 may be a standard photo resist polymer material of a type having a tendency to erode during the etching process used to remove the insulating layer 14 and conductive layer 12 to produce the desired edges. Referring now to FIG. 22*b*, the process of erosion of the resist layer 192 during etching, indicated by arrow 196, causes the exposed edges 198 of the conductive layer 12 to be sloping at an angle with respect to the surface normal of the substrate 12. This sloping, which is in the opposite direction of the undercutting that might be provided by a more robust mask in place of the resist layer 192, provides a substantial horizontal component to the surface of the edges 198. Referring now to FIG. 23, a wire 16 grown on the conductive layer 12 at the exposed edge 198 may thus better contact an adhesive interface 200, for example, from the transfer element 138 described with respect to FIG. 21 or the adhesive tape 90 of FIG. 10. This better contact in turn may provide greater removal force. In addition, the removal force indicated by arrow 202, being generally normal to the surface of the substrate 10, will have a substantial tension component 204 perpendicular to the exposed surface 198 in addition to the perpendicular shear component 206 along the surface 198 that may assist in removal of the wire 16. Generally the angle of the exposed edge 198 with respect to the exposed surface of the substrate 10 will be obtuse or greater than 90 degrees and may be greater than 135 degrees. In one embodiment, the sloped edge of the insulating and conducting layers selected from convex, planar, and concave. The sloped edge may be convex if the photoresist is more resistant than the diamond.

"Wire" as used herein refers generally both to free lengths of wire and wireforms made of wire having distinct ends or formed in a loop.

"Adhesive" as used herein means any material that tends to attach or to releasably attach to another material in the manner of an adhesive includes materials that may not be termed adhesives, adhesives, cohesive and the like. "Adhesive" includes materials that go through a phase change, such as frozen water, as well as lock and key type adhesion.

"Nanowire" as used herein means a wire with a cross-sectional area less than 1000 $\mu m^2$ and more typically a dimension of less than 100 nm in cross-section and with a length of at least 10 times its cross-sectional dimension and typically more than 1000 nm long.

"Microwire" as used herein means a wire with a cross-sectional area less than 1000 $\mu m^2$ and more typically a dimension of less than 100 μm in cross-section and with a length of at least 10 times its cross-sectional dimension and typically more than 1000 μm long.

"Conductive" and "conductor" are intended to cover materials that are noninsulating as that term is generally understood and therefore to include semiconductive materials.

It is specifically intended that the present invention not be limited to the embodiments and illustrations contained herein, but include modified forms of those embodiments including portions of the embodiments and combinations of elements of different embodiments as come within the scope of the following claims.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An apparatus for fabricating wire comprising:

a chamber configured to retain a volume of an electrochemical solution;

a substantially planar template providing a surface and a conductive layer with an electrically conductive ultranano crystalline diamond edge in nano or micro scale dimensions formed in a predefined pattern, the template mounted for rotation about a first axis perpendicular to the surface;

wherein a portion of the template is configured to be selectively immersed in the electrochemical solution in the chamber, the template configured to interact with, the template configured to interact with the electrochemical solution to form a wire;

a transfer element comprising a chamfered edge parallel to the surface, the chamfered edge having an adhesive surface and mounted for movement with respect to the template and contact with the template, the transfer element configured to remove from the template at least a portion of the wire grown by electrochemical action on the structure of the template; and an electrical power source having one electrode within the chamber connectable to an electrochemical solution in the chamber and a second electrode connecting to the electrically conductive edge of the structure.

2. The apparatus of claim 1 wherein the transfer element is a disk rotating about a second axis angled with respect to the first axis, the disk having the chamfered edge contacting the surface of the template and following an annular track on the surface of the template concentric about the first axis on the template with mutual rotation of the transfer element and template.

3. The apparatus of claim 2 wherein the chamfered edge of the disk of the transfer element is non-perpendicular with respect to the second axis.

4. The apparatus of claim 2 further including a drum rotating about a third axis and providing an adhesive surface and mounted for movement with respect to transfer element and contact between the drum adhesive surface and the chamfered edge to pull wires off of the transfer element with rotating contact between the drum and transfer element.

5. The apparatus of claim 4 wherein the drum further translates along the third axis with respect to the transfer element and with rotation of the drum to spool a wire received from the transfer element in a helical coil along a surface of the drum.

6. The apparatus of claim 5 wherein the predefined pattern defines at least one substantially continuous circle on the planar template centered about the axis.

7. The apparatus of claim 1 including a second chamber for holding a releasing liquid and positioned to admit a portion of the transfer element to move through the releasing liquid with rotation of the transfer element about the second axis.

8. The apparatus of claim 7 wherein the second chamber includes an agitation element for agitating the releasing liquid.

9. The apparatus of claim 1 wherein the chamber is open upward to admit a portion of the template during rotation of the template with the surface of the template extending vertically.

10. The apparatus of claim 1 wherein the predefined pattern of the electrically conductive edge defines multiple discontinuous elements positioned over the surface of the template.

11. The apparatus of claim 1 wherein the transfer element is a flexible tape having an adhesive surface and pressed against a surface of the template by a guide to follow an annular track on the surface of the template with rotation of the template.

12. The apparatus of claim 1 further including an electronic computer executing a stored program controlling operation of the apparatus selected from the group consisting of:

(a) a rate of rotation of the template through the electrochemical solution;

(b) an applied voltage across the electrodes; and (c) the composition of the electrochemical solution.

13. An apparatus for fabricating wire comprising:

a template having a surface defining a plane and further having an electrically conductive ultranano crystalline layer and an insulating layer, the ultranano crystalline layer disposed between the surface and the insulating layer and having an exposed conductive ultranano crystalline diamond edge, the template mounted for rotation about a first axis perpendicular to the plane;

a chamber configured to retain a volume of an electrochemical solution, the template at least partially immersible in the chamber, the template configured to interact with the electrochemical solution to form a wire on the exposed conductive ultranano crystalline diamond edge;

a transfer element comprising a chamfered edge parallel to the plane, the chamfered edge providing an adhesive surface and mounted for movement with respect to the template, the transfer element configured to remove from the template at least a portion of the wire grown by electrochemical action on the structure of the template; and an electrical power source having one electrode within the chamber connectable to an electrochemical solution in the chamber and a second electrode connecting to the conductive ultranano crystalline diamond edge.

14. The apparatus of claim 13, wherein the ultranano crystalline diamond edge is broken into discrete portions by one or more insulated portions.

15. The apparatus of claim 14, wherein the one or more insulating portions comprise a second conductive layer having an exposed second conductive layer edge perpendicular to the plane defined by the surface and a third electrode connecting to the second conductive layer edge such that the wire includes gaps.

16. The apparatus of claim 15, wherein the one or more insulating portions comprise a third conductive layer having an exposed third conductive layer edge perpendicular to the plane defined by the surface and a fourth electrode connecting to the conductive second conductive layer edge.

17. The apparatus of claim 13, wherein electrochemical solution is an ionic liquid.

18. The apparatus of claim 15, wherein the second conductive layer edge is configured to interact with a second electrochemical solution to form a first junction.

19. The apparatus of claim 15, wherein the third conductive layer edge is configured to interact with a third electrochemical solution to form a second junction.

20. The apparatus of claim 15, wherein the first junction and second junction comprise a material selected from CdS, CdSe, CdTe, Al, CuO, ZnS, and ZnSe and the first junction and second junction fill in the gaps in the wire.

21. The apparatus of claim 13, wherein the exposed conductive ultranano crystalline diamond edge is perpendicular to the plane defined by the surface.

22. The apparatus of claim 13, wherein the exposed conductive ultranano crystalline diamond edge is non-parallel to the plane defined by the surface.

23. The apparatus of claim 13 further comprising an agitation element for agitating a releasing liquid, the agitation element selected from the group consisting of an ultrasonic transducer and an air knife.

* * * * *